United States Patent [19]

Rendahl et al.

[11] Patent Number: 4,947,774

[45] Date of Patent: Aug. 14, 1990

[54] TAPE INDICATOR FOR RECOMMENDED STITCH VALUES FOR A SELECTED SEAM

[75] Inventors: Karl I. F. Rendahl; Börje G. S. Törnqvist, both of Huskvarna, Sweden

[73] Assignee: Husqvqrnq Aktiebolag, Huskvarna, Sweden

[21] Appl. No.: 401,984

[22] Filed: Sep. 1, 1989

Related U.S. Application Data

[63] Continuation of Ser. No. 192,467, May 10, 1988, abandoned.

[30] Foreign Application Priority Data

May 25, 1987 [SE] Sweden ..... 8702191

[51] Int. Cl.[5] ..... D05B 3/02

[52] U.S. Cl. ..... 112/444

[58] Field of Search ..... 112/444, 158 A

[56] References Cited

U.S. PATENT DOCUMENTS

| | | | |
|---|---|---|---|
| 4,170,950 | 10/1979 | Ozaki | 112/158 A |
| 4,270,472 | 6/1981 | Suzuki et al. | 112/444 |
| 4,342,271 | 8/1982 | Socha | 112/444 |
| 4,365,566 | 12/1982 | Laidig | 112/444 |
| 4,463,694 | 8/1984 | Sano | 112/158 A |

FOREIGN PATENT DOCUMENTS

| | | |
|---|---|---|
| 142919 | 2/1981 | Denmark . |
| 1810788 | 8/1969 | Fed. Rep. of Germany . |
| 79102018 | 11/1981 | Sweden . |

*Primary Examiner*—Andrew M. Falik

*Attorney, Agent, or Firm*—Pearne, Gordon, McCoy & Granger

[57] ABSTRACT

A display arrangement for seams on a sewing machine has lines (14,15) of symbols (11) and a marker (13) for each symbol in a line. The marker adopts an individual color for each line of symbols, whereby the number of marker devices is reduced. The setting values of the stitch, zigzag, and tension controls (16,17,18) are indicated on a tape (22) operated by a seam selector knob. The tape includes a flap (24) for the marker.

5 Claims, 4 Drawing Sheets

TAPE INDICATOR FOR RECOMMENDED STITCH VALUES FOR A SELECTED SEAM

This application is a continuation of the inventor's copending application Ser. No. 192,467, filed May 10, 1988.

BACKGROUND OF THE INVENTION

The present invention relates to an arrangement for facilitating the setting of the controls of a sewing machine.

As far as electronic sewing machines are concerned, it is known that built-in units for pre-programmed seams are used which are chosen by the electronics of the machine on indication of the operator. Such a sewing machine is known from, for example, Swedish Patent Specification No. SE-P-7910201-8. As to a mechanical sewing machine, the corresponding "pre-programming" can be carried out through indication of recommended values for the several controls of the machine. Usually, the operator must consult an instruction book to get several values of the controls before starting the sewing. An obvious simplification of this procedure can be gained by marking reference values at the controls when a stitch selector is actuated and set on the stitch wanted. Then it is easy to move the controls to those values, which then are empirically tested in order to obtain best results.

SUMMARY OF THE INVENTION

By the invention, an arrangement is presented having dials for reference values and setting devices placed in direct connection to each other. The reference value indicators are operated synchronously with a stitch selector, by which the desired seam is being set, and the reference values shown thus refer to such a setting. The advantage of this system is that the operator need not choose among various settings of the controls, but need only follow the recommended reference values indicated by the dials. The preparatory work is thereby facilitated and the setting is made uniform for one and the same seam. The advantages are gained when the arrangement is carried out with the characteristics more precisely described and claimed herein.

BRIEF DESCRIPTION OF THE DRAWINGS

An embodiment of the invention will be described in the following with reference to the accompanying drawing, as follows.

DETAILED DESCRIPTION OF THE PREFERRED EMBODIMENT

Figure 1:
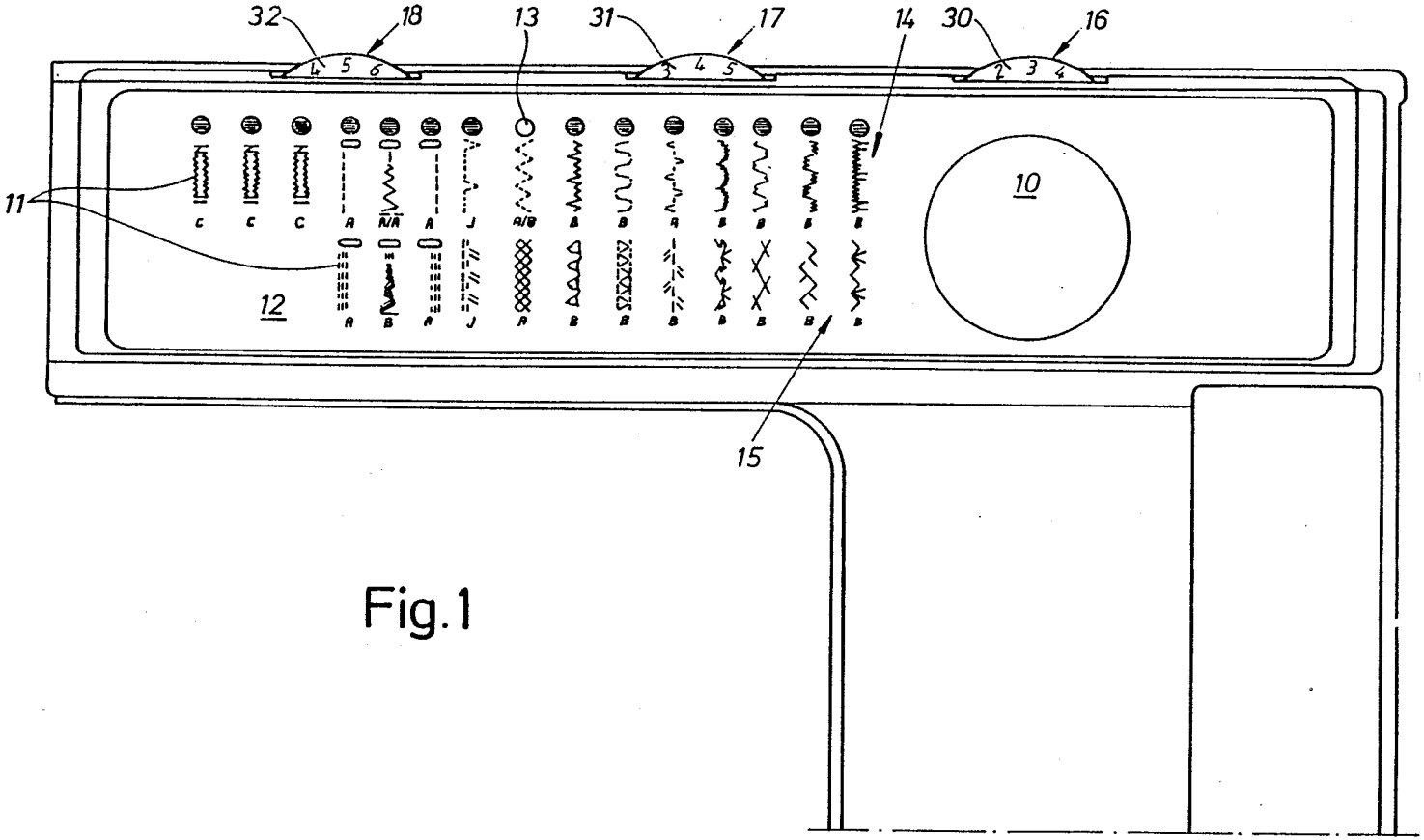
FIG. 1 is a partial elevational view of a sewing machine and control panel incorporating the present invention.
Figure 5:
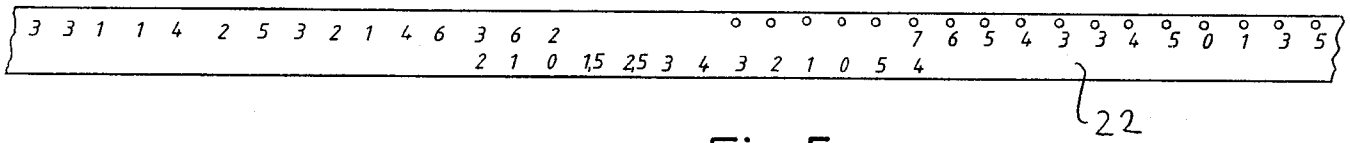
FIG. 5 is a top plan view of the movable tape.
Figure 2:
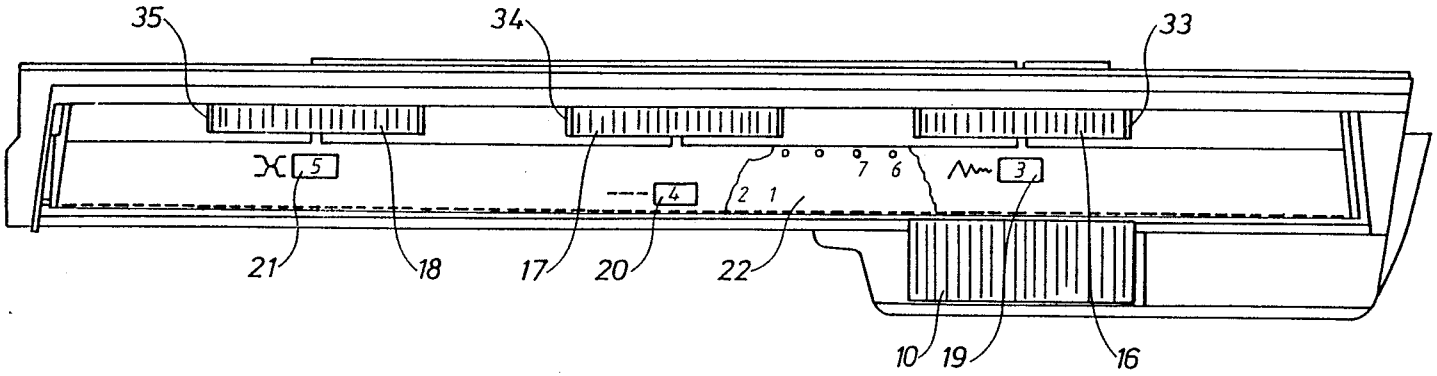
FIG. 2 is a top plan view of the control panel of FIG. 1.

With reference to FIG. 1, the machine includes a zigzag mechanism (not shown) located in the pillar of the machine body. At the upper end of this pillar, there is a stitch selector knob 10 used for choosing pattern stitches. The stitches that can be produced are shown by symbols 11 on a panel 12 forming a front piece of the machine. At each symbol there is a marker 13, in this case, a round hole with an index which is moved between the holes at the symbols when the knob 10 rotates. The symbols are divided into two lines 14, 15 which are separated so that the upper one 14 has one color and the lower one 15 has another color. On the shaft of the knob 10 there is also mounted a zigzag control in the form of a knob 16 by which the stitch width is determined. This knob is graded with numerals from, for example, 0-5. In the middle of the panel, there is a stitch length control 17, which is also in the form of a graded knob. Finally, there is a thread tension knob 18 arranged to the left of the panel with the corresponding grading. As to the knob 17, this has been provided with the capability of changing symbols between the lines 14 and 15. In connection with the selection of line by means of the knob 17, the marker 13 adopts the same color as the symbols in the line selected. The system thus far described is of prior art and need not be reported in detail.

With reference to FIGS. 2 through 5, an indication unit is arranged as windows 19, 20. 21 at each one of the knobs 16, 17, 18 on the upper side of the panel 12. Below the windows, there is a movable tape 22 with figures that can be read in the window. The tape is operated during the setting of the stitch selection knob 10 by a cog wheel 23 which rotates simultaneously with the knob and advances a new figure in the window at each step through which the knob rotates. The tape has three groups of figures placed on the tape so that the figures of zigzag, stitch length, and thread tension, belonging together, are visible in the relevant window. Furthermore, the tape has a bright index flap 24 bent down to serve as a reflector in the round holes denoted as markers 13 in FIG. 1. When the flap stands behind such, a hole, it is illuminated, owing to the fact that the index flap reflects the incoming light, in contrast to the other ones, which remain dark. The flap then indicates a pattern seam in the line 14 (see FIG. 1) on which the machine is set at present, but can be moved along the whole line. In order to obtain the pattern from the line 15 (see FIG. 1), the marker must have a specific color. In the embodiment presented, a further tape 25, which is generally transparent, is used and it is located between the holes and the index flap 24. This second tape 25 has a number of boxes of the same color as the line 15, but these are normally placed between the round holes and are not visible in front of the flap 24. The tape 25, however, can be moved so that the boxes appear in the round holes and then the flap reflects the incoming light in the hole where it is placed for the moment and, consequently, shines with the color of the colored box, i.e., the color of the box carried by tape 25 changes the apparent color of the flap 24. Therewith, the marker thus indicates that the machine is set on the pattern stitch according to the lower symbol (which thus belongs to the line 15).

Figure 3:
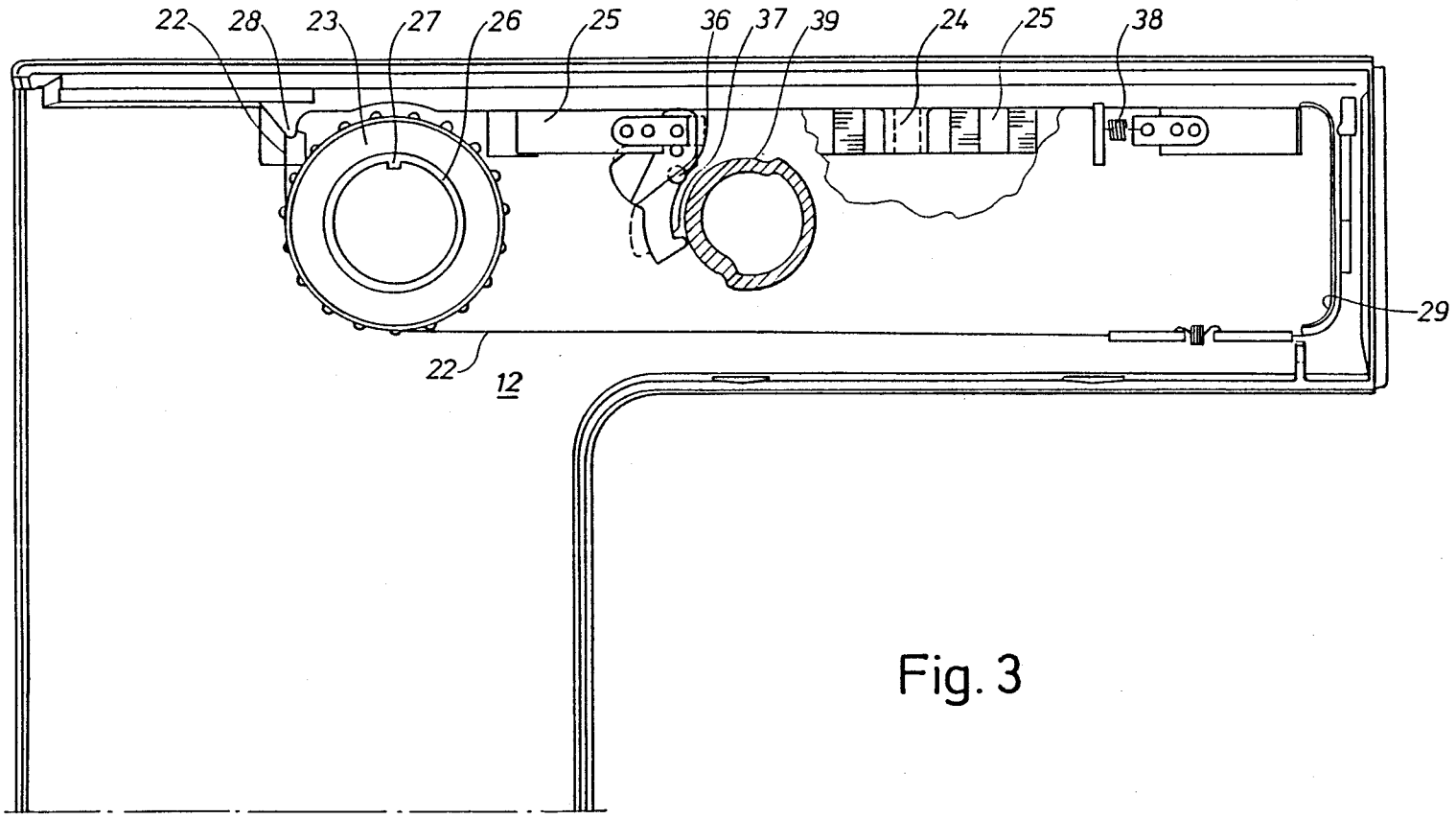
FIG. 3 is a rear elevational view of the sewing machine.
Figure 4:
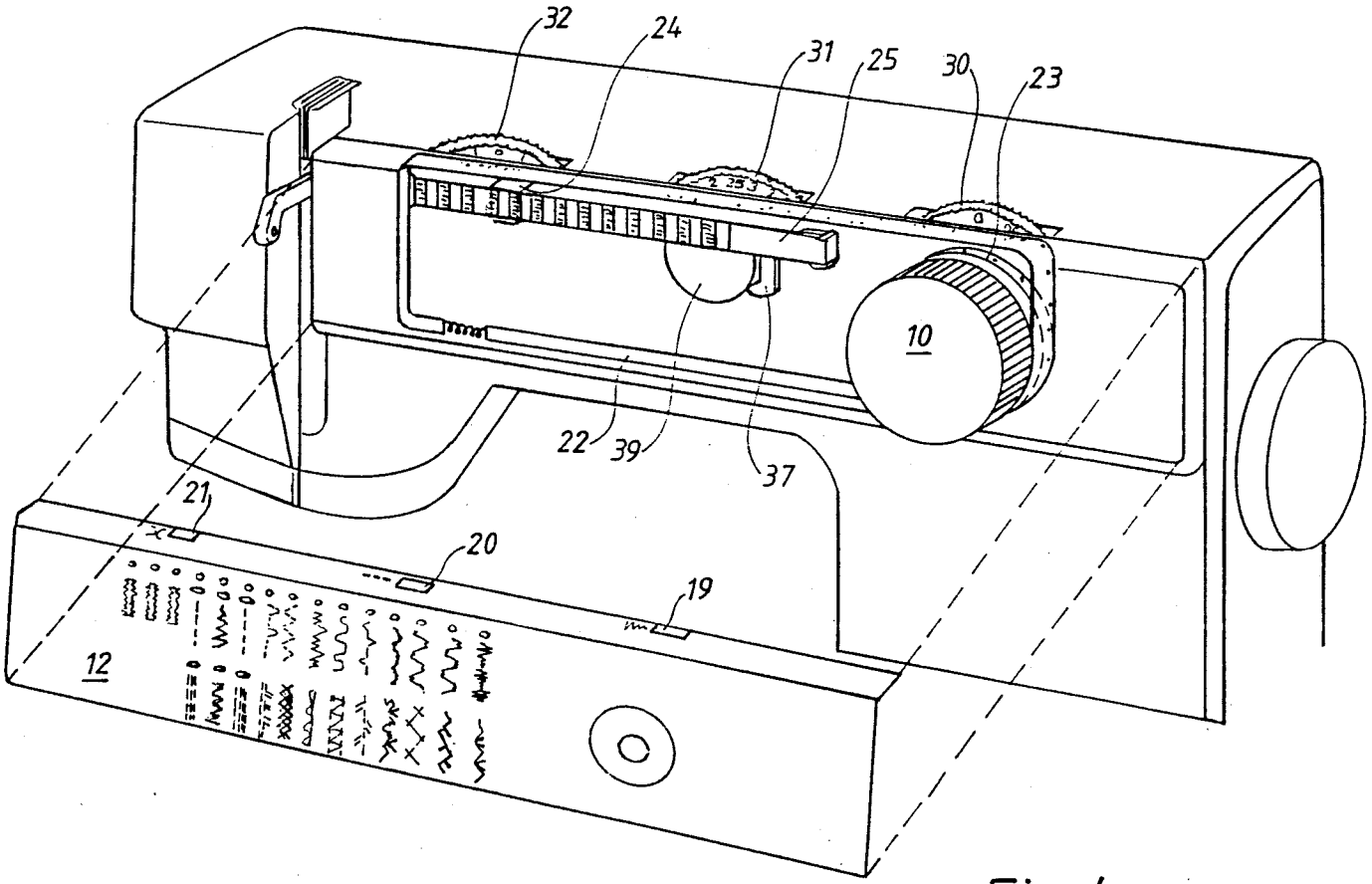
FIG. 4 is a perspective view of the sewing machine with the panel moved away.

The arrangement by which those functions are obtained is shown in FIG. 3. The cog wheel 23 is fixed on a bushing 26 which is supported in a hub through the panel and is provided with a driver 27 in which a driving member from the knob 10 is meshing. The tape 22 is put around the wheel so that the teeth fit into the perforation in the tape, which is further pulled over slide surfaces 28,29. The other knobs 16, 17, 18 are mounted in the sewing machine body, and therefore the panel is lowered over them so that a segment 30, 31, 32 becomes visible when the knobs appear in their respective openings 33, 34. 35 on the top side of the panel. With a grip on the segment, the operator can rotate the knob to the setting desired. The knobs are provided with figures and the figure standing upwards is a value of the setting of the knob.

In FIG. 3. a color changing arrangement is also shown which gives the marker one color or the other, respectively. On a shaft 36 a double-armed lever 37 is journaled in bearings, which lever in one end has an attachment for the tape 25. The other end of the tape is fixed to a spring 38, keeping the tape tense. The lever is actuated at its lower end by a curve surface 39 positioned on the knob 17 or by a pin which, through a half of the periphery of the knob, pushes the lower end to the left to the position shown by dashed lines. Thereby, the boxes on the tape are moved to a position just in front of the round holes, and the flap 24 behind each box adopts the color of the box, as previously described. When the curve surface 39 has been moved beyond the lever end, the tape resumes its normal position, due to the spring 38. The figures on the knob 17 which are visible on the segment 31 above the panel during the influence of the lever end then refer to the stitch symbols in line 15. These stitch symbols are principally performed in consequence of a change in cloth-feeding in the machine.

An extension of the system is possible by supplying several kinds of boxes on the tape 25 and the relevant lines of the symbols below the lines 14 and 15.

The embodiment now described shows how to achieve by simple means an arrangement for facilitating the setting of the control members of the machine. However, the individual details should not be considered as predominating the inventive idea which has a scope which is more closely defined in the claims.

What is claimed is:

1. In a sewing machine having a panel (12) having a back and being marked with symbols (11) for different seam types and with a marker arrangement (13) for such symbols, and controls for seam-type selection (10), stitch width (16) and stitch length (17) of which the seam-type selection control is in driving engagement with a flap (24) of the marker arrangement for moving it between said symbols independently of the setting for the stitch width or stitch length, the improvement comprising an indicator (22) located at at least the stitch width or the stitch length controls (16,17) indicating recommended values for setting those controls for a selected seam, said indicator (22) having the shape of a tape applied on a wheel (23) as well as on supporting surfaces, said wheel being connected to and activated by the selection control.

2. A sewing machine according to claim 1, wherein the dial (24) of the marker arrangement constitutes an index flap on the said tape, which flap takes positions behind holes (13) in the panel (12), each hole allotted to one of said symbols (11) on the panel.

3. A sewing machine according to claim 2, wherein the symbols are divided into at least two groups (14,15) and that a minimum of two symbols one of each group, have been allotted to one of the said holes (13) which are provided with a color means (25) operated by means of one of the said controls, and indicating one of the groups.

4. A sewing machine according to claim 3, characterized in that the color means has the shape of a transparent tape (25) located between the index flap and the back of a driving means (37,39) connected to the said control, by which driving means the transparent tape is moved.

5. A sewing machine according to claim 1, wherein the indicator (22) at the said controls is also located at a thread tension control (18) to indicate a recommended value for said control (18) dependent on the setting of the seam selection control (10).

* * * * *

UNITED STATES PATENT AND TRADEMARK OFFICE

CERTIFICATE OF CORRECTION

PATENT NO. : 4,947,774

DATED : August 14, 1990

INVENTOR(S) : Karl I. F. Rendahl, et al.

It is certified that error appears in the above-identified patent and that said Letters Patent is hereby corrected as shown below:

Column 4, line 22, after "symbols" insert a --,--.

Column 4, Claim 4, line 30, after "back of" and before "a driving", insert --the panel, and is provided with boxes of deviating color and--.

Signed and Sealed this

Seventh Day of January, 1992

*Attest:*

HARRY F. MANBECK, JR.

*Attesting Officer*

*Commissioner of Patents and Trademarks*